US009635997B2

(12) United States Patent
Lee et al.

(10) Patent No.: US 9,635,997 B2
(45) Date of Patent: May 2, 2017

(54) DISHWASHER AND METHOD OF CONTROLLING THE SAME

(71) Applicant: LG ELECTRONICS INC., Seoul (KR)

(72) Inventors: Haewoong Lee, Seoul (KR); Seongho Kim, Seoul (KR); Soohan Eo, Seoul (KR); Suhyun Kim, Seoul (KR); Jongmin Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 475 days.

(21) Appl. No.: 14/177,619

(22) Filed: Feb. 11, 2014

(65) Prior Publication Data

US 2014/0223761 A1 Aug. 14, 2014

(30) Foreign Application Priority Data

Feb. 12, 2013 (KR) ..... 10-2013-0015018
Feb. 12, 2013 (KR) ..... 10-2013-0015019

(51) Int. Cl.

| | |
|---|---|
| ***F26B 19/00*** | (2006.01) |
| ***A47L 19/00*** | (2006.01) |
| ***A47L 15/48*** | (2006.01) |
| *A47L 15/00* | (2006.01) |

(52) U.S. Cl.

CPC ..... *A47L 19/00* (2013.01); *A47L 15/483* (2013.01); *A47L 15/488* (2013.01); *A47L 15/0034* (2013.01); *A47L 15/0047* (2013.01); *A47L 2301/08* (2013.01); *A47L 2401/04* (2013.01); *A47L 2401/19* (2013.01); *A47L 2501/10* (2013.01); *A47L 2501/11* (2013.01); *A47L 2501/12* (2013.01)

(58) Field of Classification Search

CPC .... A47L 15/48; A47L 15/488; A47L 15/4225; A47L 15/0034; D06F 2058/2858; D06F 37/42; D06F 58/08; D06F 58/28

See application file for complete search history.

(56) References Cited

U.S. PATENT DOCUMENTS 4,657,036 A * 4/1987 Yake ..... A47L 15/4217 134/115 R
5,524,358 A * 6/1996 Matz ..... A47L 15/488 34/235
7,909,939 B2 * 3/2011 Brewer ..... A47L 15/483 134/56 D (Continued)

FOREIGN PATENT DOCUMENTS

CH EP 1825800 A2 * 8/2007 ..... A47L 15/4246
CN 1636498 A 7/2005

(Continued)

OTHER PUBLICATIONS

Gau et. al., English Translation.*

*Primary Examiner* — Kenneth Rinehart
*Assistant Examiner* — Jason Lau
(74) *Attorney, Agent, or Firm* — Dentons US LLP

(57) ABSTRACT

A method of controlling a dishwasher includes: driving a circulation fan disposed in a circulation duct that communicates with at least two portions of a tub; controlling a rotational speed to change the rotational speed of the circulation fan; and driving an exhaust fan to discharge the air in the tub to the outside.

19 Claims, 8 Drawing Sheets

(56) References Cited

U.S. PATENT DOCUMENTS

| | | | | |
|---|---|---|---|---|
| 8,161,986 | B2 * | 4/2012 | Alessandrelli | A47L 15/488 134/105 |
| 9,080,812 | B2 * | 7/2015 | Dreossi | A47L 15/481 |
| 2008/0264455 | A1 * | 10/2008 | Brewer | A47L 15/483 134/95.2 |
| 2008/0283099 | A1 * | 11/2008 | Peukert | A47L 15/4291 134/99.1 |
| 2009/0038661 | A1 * | 2/2009 | Hildenbrand | A47L 15/483 134/56 D |
| 2010/0083991 | A1 * | 4/2010 | Tolf | A47L 15/488 134/95.2 |
| 2010/0163549 | A1 * | 7/2010 | Gagas | H05B 6/1209 219/622 |
| 2010/0186785 | A1 * | 7/2010 | Goodyear | A47L 15/16 134/198 |
| 2010/0192977 | A1 * | 8/2010 | Jadhav | A47L 15/0034 134/18 |
| 2012/0118336 | A1 * | 5/2012 | Welch | A47L 15/4208 134/110 |
| 2012/0240962 | A1 | 9/2012 | Jerg et al. | |
| 2012/0298142 | A1 * | 11/2012 | Junge | A47L 15/4257 134/18 |

FOREIGN PATENT DOCUMENTS

| | | | | |
|---|---|---|---|---|
| CN | 1846595 | A | 10/2006 | |
| CN | 102368943 | A | 3/2012 | |
| CN | 102905603 | A | 1/2013 | |
| DE | 10022088 | A1 | 1/2001 | |
| DE | 102005023428 | A1 | 11/2006 | |
| DE | EP 2353486 | A2 * | 8/2011 | A47L 15/481 |
| FR | 2491322 | A1 | 4/1982 | |
| JP | GB 2263969 | A * | 8/1993 | A47L 15/486 |
| WO | 2011147700 | A1 | 12/2011 | |

* cited by examiner

DISHWASHER AND METHOD OF CONTROLLING THE SAME

This application claims the benefit of Korean Application Nos. 10-2013-0015018 filed Feb. 12, 2013 and 10-2013-0015019 filed Feb. 12, 2013, which are hereby incorporated by reference for all purposes as if fully set forth herein.

BACKGROUND

1. Field of the Disclosure

The present disclosure relates to a dishwasher and a method of controlling the same, particularly a dishwasher having improved efficiency of a drying cycle and a method of controlling the dishwasher.

2. Background

Dishwashers are appliances that remove food residue on dishes with high-pressure wash water sprayed from wash arms.

Dishwashers usually include a tub forming a cleaning compartment and a sump mounted on the bottom of the tub and storing wash water. The wash water is pumped to wash arms by a wash pump in the sump and the wash water pumped to the wash arms is sprayed at high pressure through an ejection hole formed in the wash arms. The wash water sprayed at high pressure hits on dishes and the dirt such as food residue on the dishes falls down to the bottom of the tub.

In general, when a washing cycle is finished, a drying cycle starts. In the drying cycle, wet dishes are dried by operating a heater. However, a large amount of water and electricity is consumed in the drying cycle, so a efficiency dry method is required.

SUMMARY

One object is to increase dry efficiency by using an air-heating dry method with higher efficiency than a water-heating dry method.

Another object is to form a uniform dish-drying area by controlling the rotational speed of a circulation fan.

Another object is to reduce power consumption by controlling a circulation fan to set a dish-drying area.

The objects are not limited to those described above and other objects may be made apparent to those skilled in the art from the claims.

In order to achieve the objects, a method of controlling a dishwasher according to an exemplary embodiment of the present invention includes: driving a circulation fan disposed in a circulation duct that communicates with at least two portions of a tub; controlling a rotational speed to change the rotational speed of the circulation fan; and driving an exhaust fan to discharge the air in the tub to the outside.

The controlling of a rotational speed may include: driving the circulation fan at a first rotational speed; and driving the circulation fan at a second rotational speed that is higher than the first rotational speed.

The controlling of a rotational speed may alternately perform the driving of the circulation fan at the first rotational speed and the driving of the circulation fan at the second rotational speed.

The controlling of a rotational speed may be performed, when the humidity of the air flowing through the circulation duct is a predetermined humidity or less.

The method of controlling a dishwasher according to an exemplary embodiment of the present invention may include driving the heating unit to heat the air flowing through the circulation duct.

A dishwasher according to an exemplary embodiment of the present invention includes: a tub forming a dishwashing space; a circulation duct having one opening through which air is discharge to the tub and the another opening through which air is sucked from the tub; and a circulation fan adjusting the circulation range of the air discharged from the circulation duct.

The tub may have a duct inlet that is open so that the air therein is discharged and flows into the circulation duct and a duct outlet that is open so that the air discharged from the circulation duct flows inside, and the duct inlet and the duct outlet may be vertically arranged so that the air flowing in the tub vertically circulates.

The circulation fan may include a variable motor that operates at least two-stage rotational speeds.

The dishwasher according to an exemplary embodiment of the present invention may include a control unit that controls the variable motor to circulate the air close to the duct inlet and the duct outlet by reducing the rotational speed of the circulation fan and to circulate the air further from the duct inlet and the duct outlet by increasing the rotational speed of the circulation fan.

The dishwasher according to an exemplary embodiment of the present invention may include: a discharge duct that sucks the air flowing in the tub through the circulation duct to the outside of the tub; and an exhaust fan that sucks air to the discharge duct, when the circulation fan stops.

The dishwasher according to an exemplary embodiment of the present invention may include a sensing unit that senses humidity of the air flowing through the circulation duct, and the control unit may control the rotational speed of the circulation fan on the basis of information from the sensing unit.

The dishwasher according to an exemplary embodiment of the present invention may include a sensing unit that senses humidity of the air flowing through the circulation duct, and the control unit may control the point of time to drive the exhaust fan on the basis of information from the sensing unit.

The dishwasher according to an exemplary embodiment of the present invention may include an exclusive dry button for driving the circulation fan in accordance with selection of a user.

The circulation fan may change in accordance with the positions of dishes in the tub.

The circulation duct may include: a circulation intake duct that extends upward from the duct inlet and then bends downward; and a circulation discharge duct that extends upward and then bends downward, and communicates with the duct outlet.

The dishwasher according to an exemplary embodiment of the present invention may include a heating unit that is disposed between the circulation intake duct and the circulation discharge duct and heats air.

The dishwasher according to an exemplary embodiment of the present invention may include: a tub that has a dishwashing space, a duct inlet through which air flows inside, and duct outlet through which air is discharged; a circulation fan that is disposed under the tub and circulates air between the duct outlet and the duct inlet; a heating unit that is disposed under the tub and heats the air flowing by the circulation fan; and a circulation duct that communicates with the duct inlet and the duct outlet, extends under the tub, and communicates with the circulation fan and the heating unit.

The details of other exemplary embodiments are included in the following detailed description and the accompanying drawings.

According to a dishwasher and a method of controlling the dishwasher according to the embodiments of the present invention, one or more effects can be achieved as follows.

First, it is possible to save water because water is not needed in the drying process.

Second, the drying efficiency is increased because it is possible to set uniform dishwashing areas.

Third, it is possible to selectively control the points where dishes are dried.

The effects are not limited to those described above and other effects not stated herein may be made apparent to those skilled in the art from the claims.

DETAILED DESCRIPTION OF THE EMBODIMENT

Figure 1:
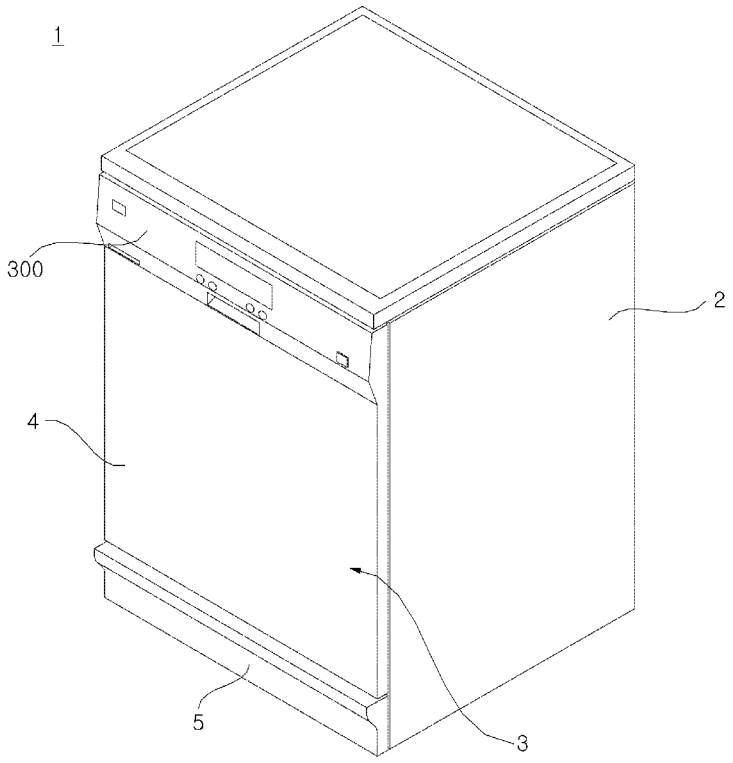
FIG. 1 is a perspective view showing an external shape of a dishwasher according to an exemplary embodiment of the present invention.

The advantages and features of the dishwashers, and methods of achieving them will be clear by referring to the exemplary embodiments that will be describe hereafter in detail with reference to the accompanying drawings. However, the present invention is not limited to the exemplary embodiments described hereafter and may be implemented in various ways, and the exemplary embodiments are provided to provide a complete description and let those skilled in the art completely know and practice the present invention. Like reference numerals may indicate like components throughout the specification.

Hereinafter, the present invention will be described with reference to the drawings illustrating a dishwasher and a method of controlling the dishwasher according to exemplary embodiments of the present invention.

Figure 2:
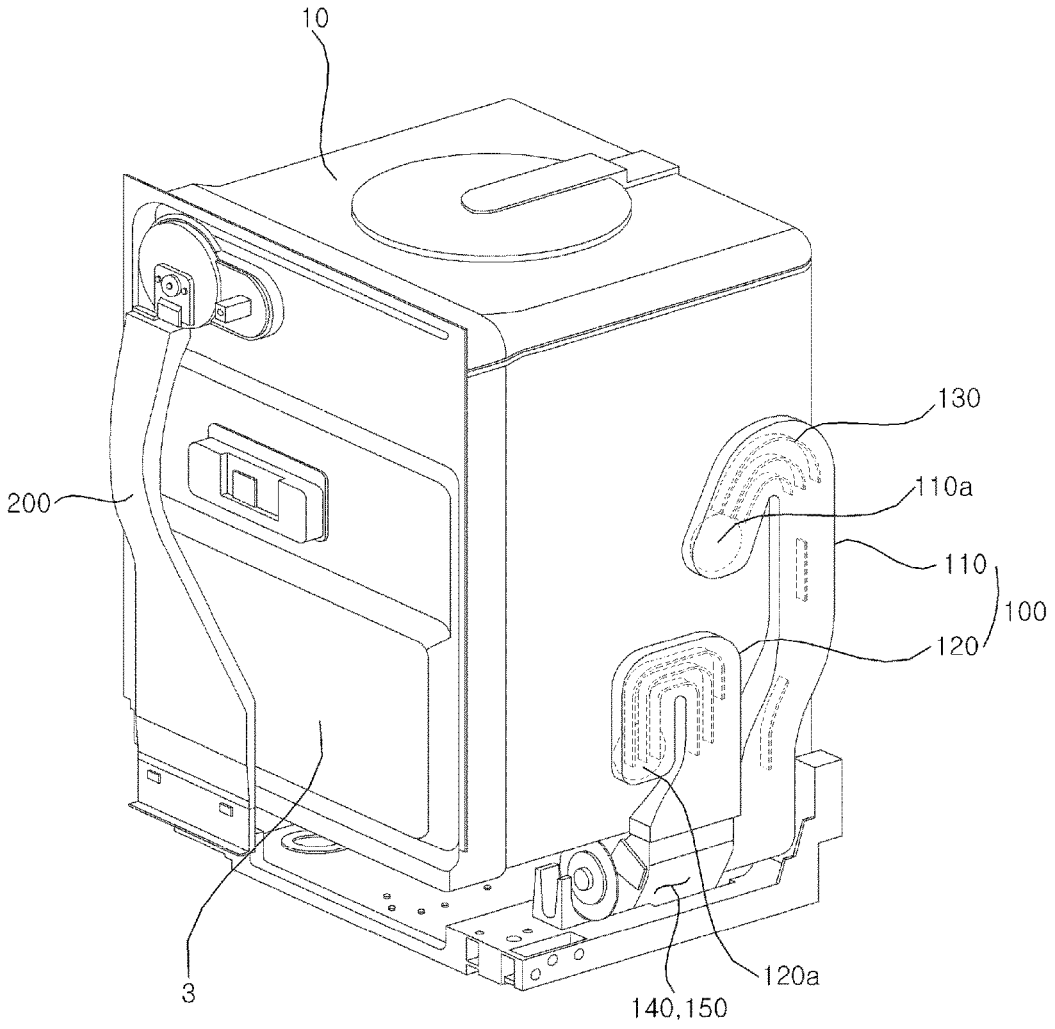
FIG. 2 is a perspective view showing the dishwasher equipped with a circulation duct and a discharge duct according to an exemplary embodiment of the present invention.
Figure 3:
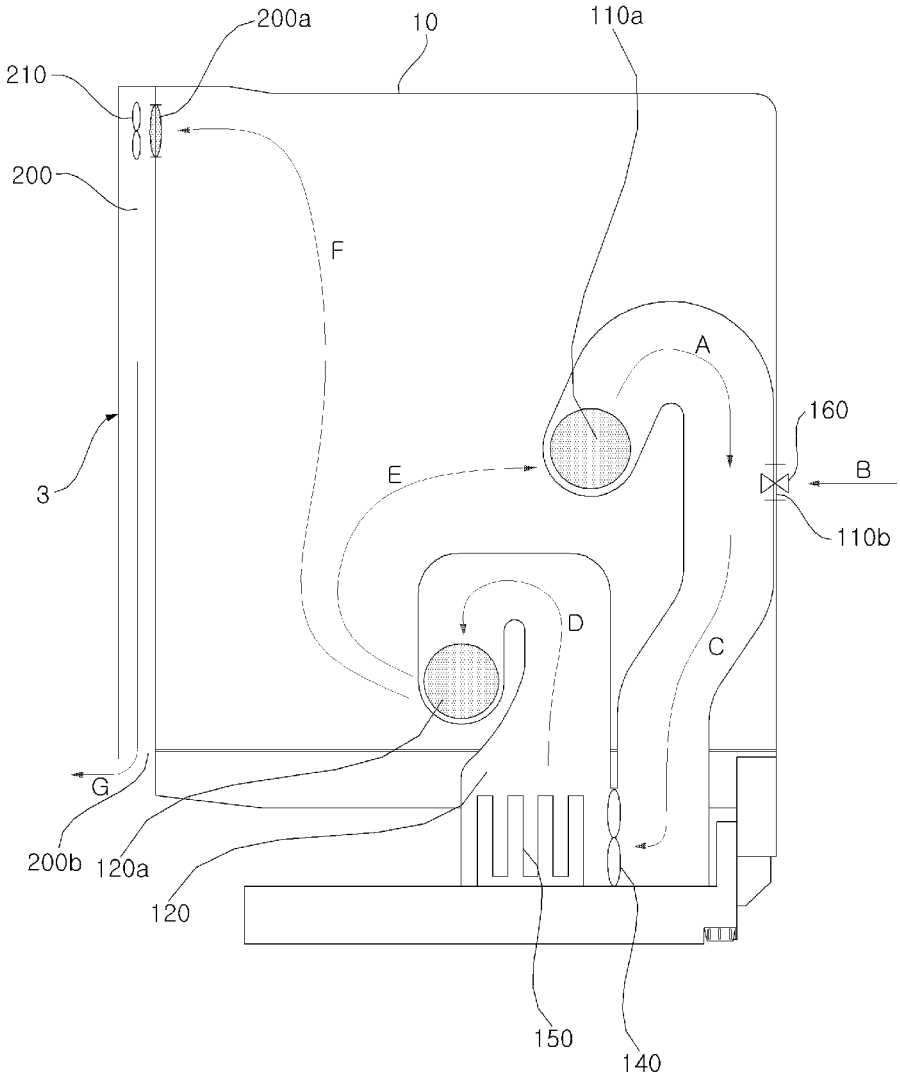
FIG. 3 is a view schematically showing the flow of air that flows in the dishwasher according to an exemplary embodiment of the present invention.
Figure 4:
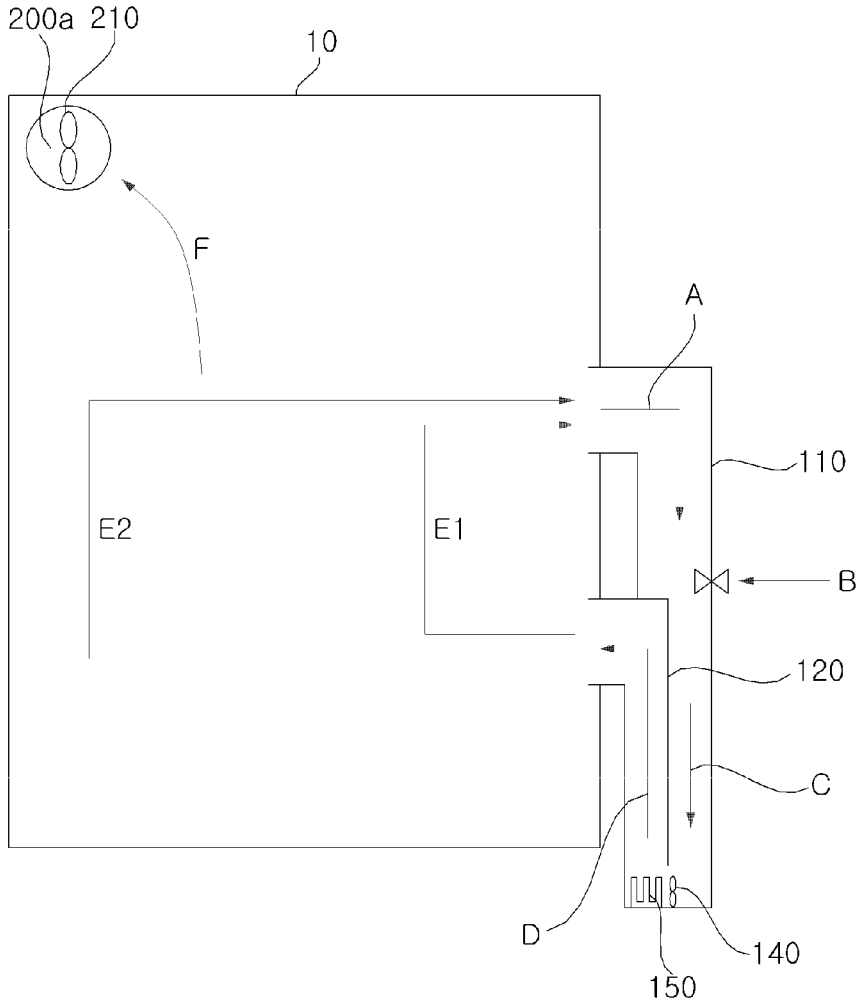
FIG. 4 is a view schematically showing the flow of air that flows in accordance with a rotational speed of a circulation fan according to an exemplary embodiment of the present invention.
Figure 5:
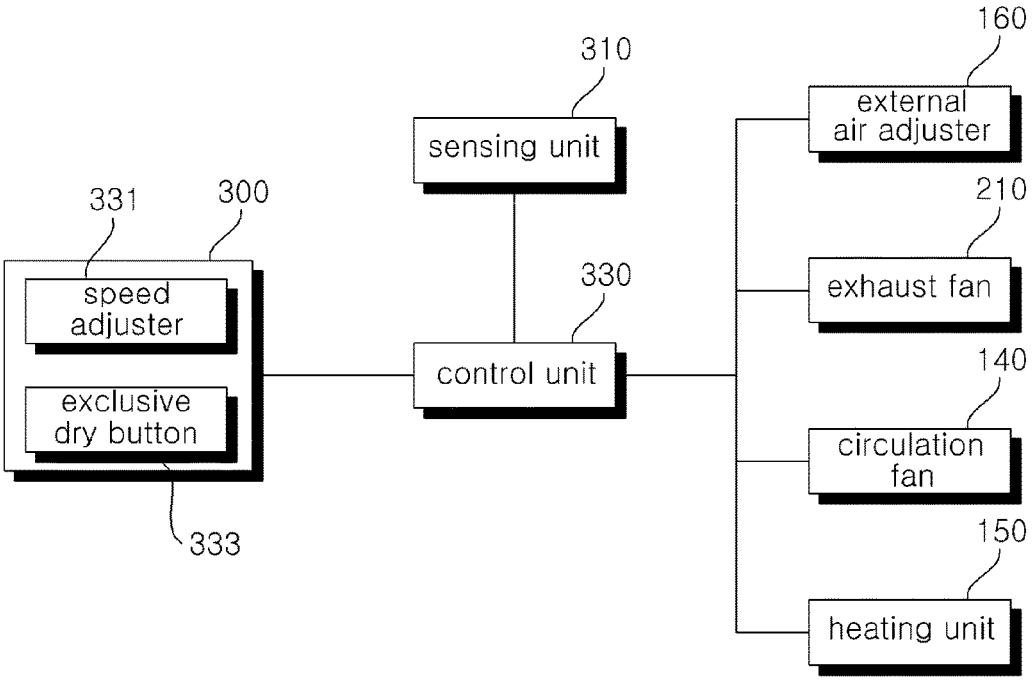
FIG. 5 is a block diagram schematically showing a relationship between a control unit and other parts according to an exemplary embodiment of the present invention.

FIG. 1 is a perspective view showing an external shape of a dishwasher according to an exemplary embodiment of the present invention, FIG. 2 is a perspective view showing the dishwasher equipped with a circulation duct and a discharge duct according to an exemplary embodiment of the present invention, FIG. 3 is a view schematically showing the flow of air that flows in the dishwasher according to an exemplary embodiment of the present invention, FIG. 4 is a view schematically showing the flow of air that flows in accordance with a rotational speed of a circulation fan according to an exemplary embodiment of the present invention, FIG. 5 is a block diagram schematically showing a relationship between a control unit and other parts according to an exemplary embodiment of the present invention.

Referring to FIGS. 1 to 5, a dishwasher 1 according to an exemplary embodiment of the present invention includes a tub 10 forming a dishwashing space, a circulation duct 100 discharging air to the tub 10 at one side and sucking air from the tub 10 at the other side, and a circulation fan 140 adjusting the circulation range of the air discharged from the circulation duct 100.

The circulation fan 140 adjusts the flow rate of air flowing through the circulation duct 100 to adjust the area where the air discharged from the circulation duct 100 and water vaporizing in the tub 10 are mixed.

A cabinet 2 forms the external appearance of the dishwasher 1 and provides a structure for accommodating parts. The front of the cabinet 2 is open. The tub 10 into which wash water is sprayed is disposed in the cabinet 2. A user can put dishes into the tub 10. The door 3 opens/closes the front of the cabinet 2. The door 3 closes the tub 10. The door 3 is pivotably coupled to the front of the cabinet 2. A front cover 4 is disposed on the front of the door 3. The front cover 4 makes the external appearance beautiful. A lower cover 5 is disposed on the front of the cabinet 2. The lower cover is disposed at the lower end of the front of the cabinet 2.

The front of the tub 10 is closed by the door 3. Wash water is sprayed into the tub 10. A rack that holds dishes is disposed in the tub 10. The rack can be moved forward/backward in the tub 10. It is preferable that a plurality of racks is provided. A plurality of wash arms is disposed in the tub 10 and spray wash water.

The tub 10 communicates with discharge duct 200. The air in the tub 10 is discharged to the outside through the discharge duct 200. The circulation duct 100 sucks the air in the tub 10. The air sucked into the circulation duct 100 from the tub 10 is discharged back to the tub 10. Both ends of the circulation duct 100 communicate with the tub 10. The air sucked through one side of the circulation duct 100 is discharged back to the tub 10 through the other side of the circulation duct 100. A control unit 330 drives an exhaust fan 210 after stopping a circulation fan 140. An input unit 300 may be disposed on the front of the cabinet 2. A user can operate the dishwasher 1 through the input unit 300. The control unit 330 is connected with the input unit 300. The control unit 330 controls the operation of electric parts of the dishwasher 1 in response to information from the input unit 300. The control unit 330 may be connected with a sensing unit 310.

The circulation fan 140 sucks and/or discharges air from/to the circulation duct 100. The circulation fan 140 is disposed between a circulation intake duct 110 and a circulation discharge duct 120 and rotates to suck and/or discharge air. The control unit 330 is connected with the circulation fan 140. The control unit 330 controls the operation of the circulation fan 140. The control unit 330 can determine the rotational speed and/or the operation time and/or the stop time of the circulation fan 140.

The control unit 330 circulates the air close to a duct inlet 110*a* and a duct outlet 120*a* by reducing the rotational speed of the circulation fan 140 and circulates the air far from the duct inlet 110*a* and the duct outlet 120*a* by increasing the rotational speed of the circulation fan 140. For example, with a low rotational speed, the air discharged from the circulation duct 100 circulates close to the circulation duct 100. As another example, with a high rotational speed, the air discharged from the circulation duct 100 is discharged even far from the circulation duct 100 and flows back into the circulation duct 100. The control unit 330 controls the area of the air circulating in the tub 10 by controlling the rotational speed of the circulation fan 140.

The control unit 330 can increase or decrease in stages the rotational speed of the circulation fan 140. A variety of air channels are formed in the tub 10 in accordance with the rotational speed of the circulation fan 140. The air channels are described in detail below. The door 3 is disposed on the open front of the tub 10. A discharge port 200*a* is formed in the door 3.

The duct outlet 120*a* and the duct inlet 110*a* are formed at one side of the tub 10. Preferably, they are vertically arranged so that the air discharged through the duct outlet 120*a* can flow up to the duct inlet 110*a* and the duct outlet 120*a*. Most preferably, the duct inlet 110*a* is formed above the duct outlet 120*a* and the discharge port 200*a* is formed higher than the duct inlet 110*a*.

The tub 10 according to an exemplary embodiment of the present invention has the duct inlet 110*a* that is open so that internal air is discharged from the tub 10 and flows into the circulation duct 100 and the duct outlet 120*a* that is open so that the air discharged from the circulation duct 100 flows into the tub 10, and the duct inlet 110*a* and the duct outlet 120*a* are vertically arranged so that the air flowing in the tub 10 vertically circulates.

The duct outlet 120*a* and the duct inlet 110*a* can be vertically arranged. The duct outlet 120*a* and the duct inlet 110*a* may be formed on the same side of the tub 10. Preferably, the duct inlet 110 and the duct outlet 120*a* may be formed on a side of the tub 10.

The front of the tub 10 is open and closed by the door 3. The duct outlet 120*a* and the duct inlet 110*a* are formed at the left side or the right side of the tub 10. The duct outlet 120*a* may be formed lower than the duct inlet 110*a*. The duct inlet 110*a* may be formed behind the duct outlet 120*a*, from the front of the tub 10.

The duct inlet 110*a* is preferably arranged diagonally to the duct outlet 120*a* so that the air discharged from the duct outlet 120*a* can be discharged through the rear of the tub 10 after flowing up. The duct inlet 110*a* and the duct outlet 120*a* are spaced from each other so that the air in the tub 10 can be diffused as much as possible.

The tub 10 may be open at least at two portions to communicate with ducts. One side of the circulation duct 100 communicates with the duct inlet 110*a* The other side of the circulation duct 100 communicates with the duct outlet 120*a* The air flowing into the duct inlet 110*a* flows back to the tub 10 through the duct outlet 120*a*. The tub 10 and the circulation duct 100 form a circulation channel through which air circulates.

The air flowing into the duct inlet 110*a* flows through the circulation intake duct 110. The air flowing through the circulation intake duct 110 moves to the circulation discharge duct 120. The air flowing through the circulation discharge duct 120 is discharged to the duct outlet 120*a*. One side of the circulation intake duct 110 communicates with the tub 10 and the other side extends under the tub 10.

The circulation intake duct 110 extends downward after bending at the top. A portion of the circulation intake duct 110 may be disposed in contact with the cabinet. One side of the circulation discharge duct 120 communicates with the tub 10 and the other side extends under the tub 10. An external air inlet 110*b* may be formed at one side of the circulation duct 100. External air may be sucked into the external air inlet 110*b* by the circulation fan 140. Preferably, the external air inlet 110*b* is formed at the circulation intake duct 110. More preferably, the external air inlet 110*b* is formed in the path along which the circulation duct 100 bends at the top and extends downward.

The external air inlet 110*b* may communicate with the rear of the cabinet. An external air adjuster 160 controls opening/closing of the external air inlet 110*b*. The external air adjuster 160 may be a valve controlling inflow of air. The control unit 330 is connected with the external air adjuster 160. The control unit 330 controls opening/closing of the external air adjuster 160. The control unit 330 can determine the point of opening time and/or the point of closing time of the external air adjuster 160.

At least one of the circulation duct 100 and the discharge duct 200 may include a condensation wall 130 elongated in the flow direction of air so that moisture in air condensates. A plurality of condensation walls 130 may be formed. The condensed-water produced by coming in contact with the condensation wall 130 flows down.

The lower end of the condensation wall may be connected with a drain pipe (not shown) so that the condensed-water produced therein is collected and discharged to the outside. One side of the circulation duct 100 is elongated under the tub 10. Sides of the circulation intake duct 110 and the circulation discharge duct 120 extend under the tub 10. The drain pipe is connected with at least any one of the circulation intake duct 110 and the circulation discharge duct 120.

The circulation fan 140 according to an exemplary embodiment of the present invention includes a variable motor that adjusts the rotational speed so that at least two-stage rotational speeds can be maintained. The control unit 330 can rotate the circulation fan 140 at the first rotational speed. The control unit 330 can rotate the circulation fan 140 at the second rotational speed. The control unit 330 may increase in stages the rotational speed of the circulation fan 140. The first rotational speed and the second rotational speed are different. The rotational speeds determine the circulation area of the air flowing in the tub 10. The first rotational speed and the second rotational speed determine the circulation path of the air circulating in the tub 10.

The circulation fan 140 according to an exemplary embodiment of the present invention changes in rotational speed, as time passes. For example, the rotational speed may be maintained at a low level in the early state of the drying cycle and may be maintained at a high level in the later stage of the drying cycle. In contrast, the rotational speed can be reduced in stages. The control unit 330 may alternately change and maintain the rotational speed of the circulation fan 140 at a high level and a low level.

The dishwasher 1 according to an exemplary embodiment of the present invention includes the discharge duct 200 for sucking air discharged from the circulation duct 100 and discharging it to the outside of the tub 10 and the exhaust fan 210 sucking air from the discharge duct 200.

The discharge duct 200 is disposed on a side of the tub 10. The discharge duct 200 forms an air channel G. One side of the discharge duct 200 communicates with the discharge port 200*a* and other side communicates with the discharge port 200*b* of the door 3.

The dishwasher 1 according to an exemplary embodiment of the present invention includes the door 3 opening/closing the tub 10 and the door 3 has the discharge port 200*a* that communicates with the tub 10 so that the air in the tub 10 can flow to the exhaust fan 210.

The door 3 opens/closes the front of the cabinet 2. The door 3 closes the tub 10. The door 3 pivotably coupled to the front of the cabinet 2. The door 3 is equipped with the exhaust fan 210. The discharge duct 200 is disposed in the door 3. The discharge port 200*a* communicates with the tub 10. The air in the tub 10 is sent to the discharge duct 200 through the discharge port 200*a* by the exhaust fan 210. The air flowing through the discharge duct 200 flows to the bottom of the door 3 and is discharged through the discharge port 200*b* of the door 3.

The exhaust fan 210 according to an exemplary embodiment of the present invention is driven, when a predetermined exhaust condition is satisfied. The exhaust fan 210 is connected with the control unit 330. The control unit 330 controls the exhaust fan 210 such that the exhaust fan 210 can be started at a predetermined point of time. The sensing unit 310 can sense the temperature and/or moisture of the air in the air circulating in the tub 10 and/or the operation time of the drying cycle, etc.

The control unit 330 can determine the time of operating the exhaust fan 210 in accordance with the sensing value of the sensing unit 310. The control unit 330 can operate the exhaust fan 210 at the determined time. The time of operating the exhaust fan 210 may be determined in advance. The control unit 330 controls the rotational speed of the exhaust fan 210. The control unit 330 can control the exhaust fan 210 to start and/or stop.

The dishwasher 1 according to an exemplary embodiment of the present invention includes an exclusive dry button 333 for driving the circulation fan 140 in accordance with selection of a user. The exclusive dry button 333 may be formed in the input unit 300 on the front of the door 3. The input unit 300 may be disposed on the front of the cabinet 2. The exclusive dry button 333 allows a drying process to be individually performed, even without the wash cycle that sprays wash water with a detergent and/or a rinse cycle for rinsing out dishes after the wash cycle.

When the exclusive dry button 333 is pressed, the control unit 330 gives an instruction of exclusive drying. The control unit 330 can directly drive the circulation fan 140 and/or a heating unit 150 without the wash cycle and/or the rinse cycle. The control unit 330 can drive the exhaust fan 210 or stop other electric parts, depending on the predetermined time or the result of the sensing value.

The dishwasher 1 according to an exemplary embodiment of the present invention includes a speed adjuster 331 that adjusts the rotational speed of the circulation fan 140 in accordance with selection of a user. The speed adjuster 331 may be disposed in the input unit 300. The speed adjuster 331 can adjust the circulation path of the air flowing in the tub 10. The speed adjuster 331 adjusts the rotational speed of the circulation fan 140.

The dishwasher 1 according to an exemplary embodiment of the present invention includes the heating unit 150 that heats the air in the circulation duct 100. The heating unit 150 is connected with the control unit 330. The control unit 330 controls the operation of the heating unit 150. The control unit 330 can determine the temperature and/or the operation time and/or the stop time of the heating unit 150. The control unit 330 can increase the amount of saturated vapor by increasing the temperature of air.

The step of operating the exhaust fan 210 and/or the step of driving the circulation fan 140 and/or the step of driving the heating unit 150 may be repeated at appropriate intervals. For example, opening of the exhaust fan 210 and the external air adjuster 160 may be periodically performed. Further, when the exhaust fan 210 is operated, the heating unit 150 may be stopped, or when the exhaust fan 210 is operated, the external air adjuster 160 may be opened and the circulation fan 140 is stopped.

The rotational speed of the circulation fan 140 according to an exemplary embodiment of the present invention may change in accordance with the positions of dishes in the tub 10. The control unit 330 keeps an appropriate rotational speed in accordance with the positions of dishes. For example, when a dish comes close to the circulation duct, it has only to circulate air through the path of the air channel E. In this process, it is possible to finish the drying cycle with the first rotational speed maintained without increasing the rotational speed to the second rotational speed.

Figure 6:
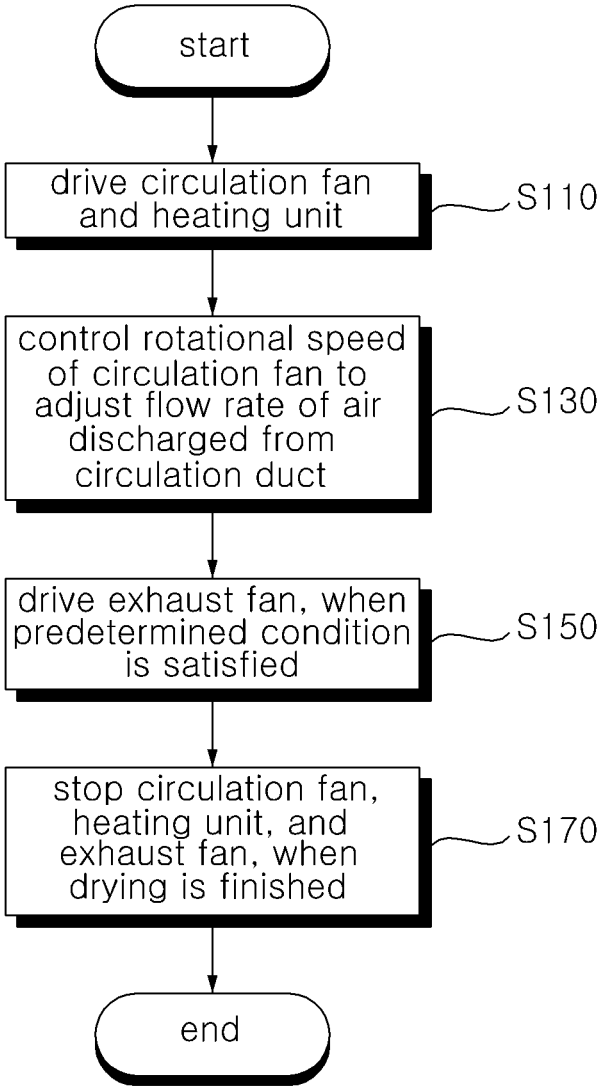
FIG. 6 is a flowchart showing a method of controlling a dishwasher according to an exemplary embodiment of the present invention.
Figure 7:
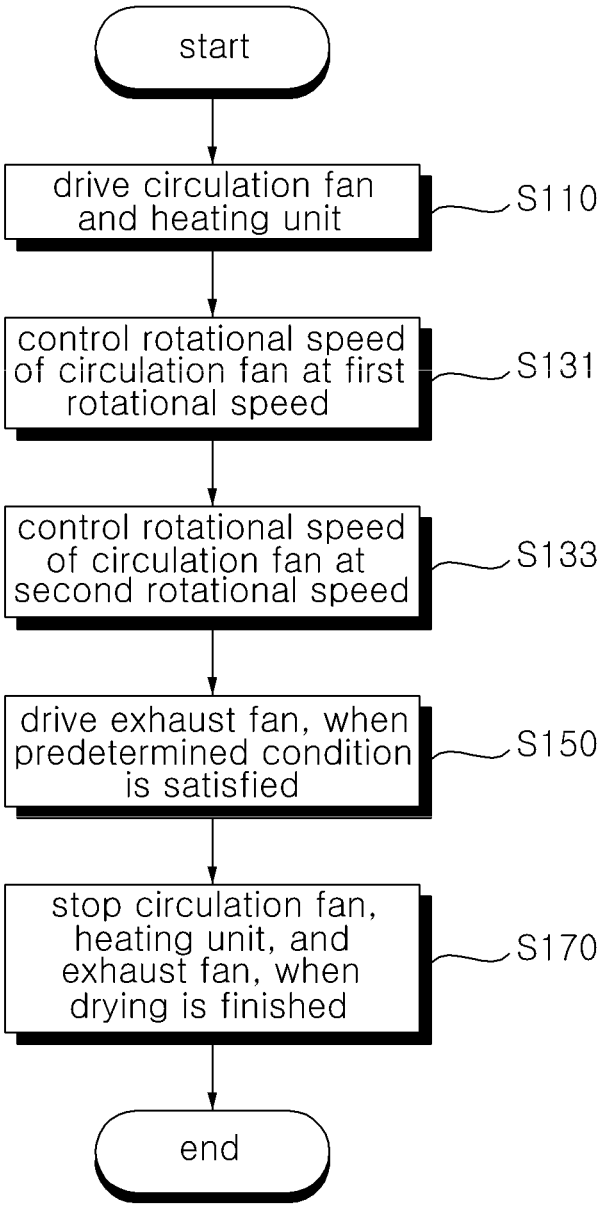
FIG. 7 is a flowchart schematically showing a method of controlling a circulation fan according to an exemplary embodiment of the present invention.
Figure 8:
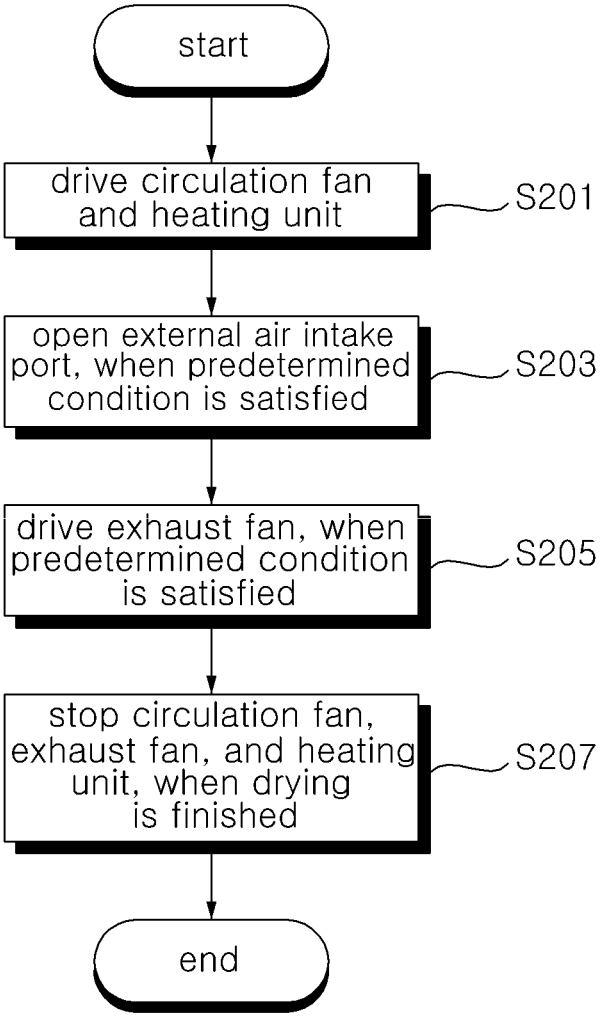
FIG. 8 is a flowchart showing a method of controlling a dishwasher according to another exemplary embodiment of the present invention.

FIG. 6 is a flowchart illustrating a method of controlling a dishwasher according to an exemplary embodiment of the present invention, FIG. 7 is a flowchart schematically illustrating a method of controlling a circulation fan according to an exemplary embodiment of the present invention, and FIG. 8 is a flowchart illustrating a method of controlling a dishwasher according to another exemplary embodiment of the present invention.

Referring to FIGS. 6 to 8, a method of controlling the dishwasher 1 according to an exemplary embodiment of the present invention includes: driving the circulation fan 140 in the circulation duct 100 to suck the air in the tub 10 to one side of the circulation duct 100 that communicates with at least two portions of the tub 10 and to discharge the sucked air back to the tub 10 (S110); controlling the rotational speed of the circulation fan 140 to adjust the flow rate of the air discharged from the circulation duct 100 (S130); and driving the exhaust fan 210 to discharge the air in the tub 10 to the outside, when a predetermined condition is satisfied (S150).

The control unit 330 controls the operation of the circulation fan 140. As the circulation fan 140 is rotated, the air in the tub 10 flows into the circulation duct 100. The air flowing in the circulation duct 100 is discharged back to the tub 10. The control unit 330 drives the exhaust fan 210, when the sensing value of the sensing unit 310 satisfies a predetermined condition. The sensing unit 310 may be a temperature sensor that senses the temperature of the air flowing through the circulation duct 100 or the air in the tub 10.

The sensing unit 310 may be a humidity sensor that senses the humidity of the air flowing through the circulation duct 100 or the air in the tub 10. The sensing unit 310 senses the humidity of the air flowing through the circulation duct 100. The control unit 330 controls the rotational speed of the circulation fan 140 in response to information from the sensing unit 310. For example, when the measured humidity of air is a predetermined value or less, the rotational speed of the circulation fan 140 is changed and the air in another area is circulated. The control unit 330 can determine the time of driving the exhaust fan 210 in response to information from the sensing unit 310. For example, the control unit 330 discharges humid air to the outside by driving the exhaust fan 210, when it is recognized that the reduction of humidity reaches a critical value.

The sensing unit 310 may be a timer that measures the operation time of the drying cycle. The time of driving the exhaust fan 210 may be determined in advance. The sensing unit 310 can sense the temperature and/or moisture of the air in the air circulating in the tub 10 and/or the operation time of the drying cycle, etc.

The control unit 330 can determine the time of operating the exhaust fan 210 in accordance with the sensing value of the sensing unit 310. The control unit 330 operates the exhaust fan 210 at the determined time. The time of operating the exhaust fan 210 may be determined in advance. The control unit 330 controls the rotational speed of the exhaust fan 210. The control unit 330 can control the exhaust fan 210 to start and/or stop. When drying is finished, the control unit 330 may perform the step (S170) of stopping the circulation fan 140, the exhaust fan 210, and the heating unit 150.

According to an exemplary embodiment of the present invention, the controlling of the rotational speed (S130) may include at least any one of driving the circulation fan 140 at the predetermined first rotational speed (S131) and driving the circulation fan 140 at the second rotational speed higher than the first rotational speed (S133).

The control unit 330 can rotate the circulation fan 140 at the first rotational speed. The control unit 330 can rotate the circulation fan 140 at the second rotational speed. The control unit 330 may increase in stages the rotational speed of the circulation fan 140. The control unit 330 alternately performs the driving of the circulation fan 140 at the first rotational speed (S131) and the driving of the circulation fan 140 at the second rotational speed (S133).

The first rotational speed and the second rotational speed are different. The rotational speeds determine the circulation area of the air flowing in the tub 10. For example, when the rotational speed is low, the air discharged from the circulation duct 100 circulates in an area close to the circulation duct 100. As another example, with a high rotational speed, the air discharged from the circulation duct 100 reaches an area further from the circulation duct 100 and flows back into the circulation duct 100. The first rotational speed and the second rotational speed may be determined in advance. The controlling of the rotational speed (S130) may be performed, when the humidity of the air flowing through the circulation duct 100 drops to a predetermined humidity or less. The sensing unit in the circulation duct 100 senses humidity. The control unit 330 controls the area where dishes are usually dried, by controlling the rotational speed of the circulation fan 140. The first rotational speed and the second rotational speed determine the circulation path of the air circulating in the tub 10. For example, the circulation path may be indicated by the air channel E1 and the air channel E2 in the tub. The first rotational speed may make the air channel E1. The second rotational speed may make the air channel E2. Dishes close to the circulation duct 100 are mostly dried in the air channel E1 and dishes far from the circulation duct 100 are mostly dried in the air channel E2.

According to an exemplary embodiment of the present invention, the controlling of the rotational speed (S130) may perform the driving of the circulation fan 140 at the second rotational speed (S133) after the driving of the circulation fan 140 at the first rotational speed (S131). The time for which the circulation fan 140 is driven at the first rotational speed and the time for which the circulation fan 140 is driven at the second rotational speed may be determined in advance.

According to an exemplary embodiment of the present invention, the controlling of the rotational speed (S130) may perform the driving of the circulation fan 140 at the first rotational speed (S131) after the driving of the circulation fan 140 at the second rotational speed (S133). Selection of the rotational speed may depend on the positions of dishes in the tub 10.

According to an exemplary embodiment of the present invention, the method includes driving the heating unit 150 so that the air flowing through the circulation duct 100 is heated by exchanging heat (S110). The heating unit 150 may be disposed in the circulation duct 100. The heating unit 150 is disposed under the tub 10. A machine room receiving the wash pump 45 that pressurizes wash water and a sump 60 where the wash water sprayed to the tub 10 collects is disposed under the tub 10. The heating unit 150 is disposed in the machine room. The heating unit 150 is disposed between the circulation intake duct 110 and the circulation discharge duct 120 and exchanges heat with flowing air.

For example, one side of the heating unit 150 may communicate with the circulation intake duct 110 and the other side may communicate with the circulation discharge duct 120. The heating unit 150 is connected with the control unit 330. The control unit 330 controls the operation of the heating unit 150. The control unit 330 can determine the temperature and/or the operation time and/or the stop time of the heating unit 150.

Further, the method may include opening the external air inlet 110*b*, when a predetermined condition is satisfied (S203), as in FIG. 8. Accordingly, the drying efficiency can be further increased. The predetermined condition is given by the control unit 330 on the basis of the sensing value of the sensing unit 310. The external air inlet 110*b* is opened/closed by the external air adjuster 160.

The channel of the air flowing in the tub 10 and the channel of the air discharge from the tub 10 can be indicated by the arrows A, B, C, D, E, F, and G. The air channel A may meet the air channel B through which external air flows inside. The air passing through the air channel A and the air passing through the air channel B flow through the air channel C. The air channel B may be closed by the external air adjuster 160. The air channel B is selectively opened/closed by the control unit 330. The heating unit 150 and the circulation fan 140 are disposed between the air channel C and the air channel D. The air discharged from the circulation duct 100 can flow through the air channel E coming into the circulation duct 100 or the air channel F coming out to the outside.

The air channel E is connected with the duct inlet 110*a*. The air channel F is connected with the discharge port 200*a*. The air flowing in the discharge duct 200 flows through the air channel G and is then discharged to the discharge port 200*b* of the door 3. Since the exhaust fan 210 is selectively driven, the air channels F and G may be closed. For example, when the first rotational speed is lower than the second rotational speed, the air discharged from the circulation fan 140 rotating at the first rotational speed flows through the air channel E1. The air discharged from the circulation fan 140 rotating at the second rotational speed flows through the air channel E2.

Further, although FIG. 6 shows that the exhaust fan 210 is driven after the circulation fan is driven at the first rotational speed and the second rotational speed, the present invention is not necessarily limited thereto. It may be possible to temporarily operate the exhaust fan 210 after driving the circulation fan 140 at the first rotational speed and then to operate the exhaust fan 210 after driving the circulation fan 140 at the second rotational speed. Further, it is possible to repeat operating the circulation fan 140 and the exhaust fan 210 several times. Further, in the driving of the exhaust fan 210, the heating unit 150 and/or the circulation fan 140 may be stopped. This may be set in different ways, depending on the ability of sucking/discharging of the circulation fan 140 and the ability of heat exchanging of the heating unit 150.

FIG. 1 is a perspective view showing the external shape of a dishwasher according to an exemplary embodiment of the present invention, FIG. 2 is a perspective view showing the dishwasher equipped with a circulation duct and a discharge duct according to an exemplary embodiment of the present invention, FIG. 3 is a view schematically showing the flow of air that flows in the dishwasher according to an exemplary embodiment of the present invention, FIG. 4 is a view schematically showing the flow of air that flows in accordance with the rotational speed of a circulation fan according to an exemplary embodiment of the present invention, FIG. 5 is a block diagram schematically showing the relationship between a control unit and other parts according to an exemplary embodiment of the present invention.

Referring to FIGS. 1 to 5, a dishwasher 1 according to an exemplary embodiment of the present invention includes a tub 10, a discharge duct 200 that communicates with the tub 10 to discharge the air in the tub 10 to the outside, and a circulation duct 100 that sucks the air in the tub 10 and communicates with at least two portions of the tub 10 so that the sucked air is discharged back to the tub 10.

A cabinet 2 forms the external appearance of the dishwasher 1 and provides a structure for accommodating parts. The front of the cabinet 2 is open. The tub 10 into which wash water is sprayed is disposed in the cabinet 2. A user can put dishes into the tub 10. The door 3 opens/closes the front of the cabinet 2. The door 3 closes the tub 10. The door 3 is pivotably coupled to the front of the cabinet 2. A front cover 4 is disposed on the front of the door 3. The front cover 4 makes the external appearance beautiful. A lower cover 5 is disposed on the front of the cabinet 2. The lower cover is disposed at the lower end of the front of the cabinet 2.

The front of the tub 10 is closed by the door 3. Wash water is sprayed into the tub 10. A rack that holds dishes is disposed in the tub 10. The rack can be moved forward/backward in the tub 10. It is preferable that a plurality of racks is provided.

A plurality of wash arms is disposed in the tub 10 and spray wash water. The tub 10 communicates with discharge duct 200. The air in the tub 10 is discharged to the outside through the discharge duct 200. The circulation duct 100 sucks the air in the tub 10.

The air sucked into the circulation duct 100 from the tub 10 is discharged back to the tub 10. Both ends of the circulation duct 100 communicate with the tub 10. The air sucked through one side of the circulation duct 100 is discharged back to the tub 10 through the other side of the circulation duct 100. The input unit 300 may be disposed on the front of the cabinet 2.

A user can operate the dishwasher 1 through the input unit 300. The control unit 330 is connected with the input unit 300. The control unit 330 controls the operation of electric parts of the dishwasher 1 in response to information from the input unit 300. The control unit 330 may be connected with a sensing unit 310. The sensing unit 310 is described in detail below.

The tub 10 according to an exemplary embodiment of the present invention has a duct inlet 110*a* that is open so that air is discharged and flows into the circulation duct 100 and a duct outlet 120*a* that is open so that the air flowing through the circulation duct 100 is discharged to the tub 10.

The tub 10 may be open at least at two portions to communicate with ducts. One side of the circulation duct 100 communicates with the duct inlet 110*a* The other side of the circulation duct 100 communicates with the duct outlet 120*a* The air flowing into the duct inlet 110*a* flows back to the tub 10 through the duct outlet 120*a*. The tub 10 and the circulation duct 100 form a circulation channel through which air circulates.

According to an exemplary embodiment of the present invention, the duct outlet 120*a* and the duct inlet 110*a* are vertically arranged so that the air in the tub 10 vertically circulates. The duct outlet 120*a* and the duct inlet 110*a* can be vertically arranged. The duct outlet 120*a* and the duct inlet 110*a* may be formed on the same side of the tub 10. Preferably, the duct inlet 110 and the duct outlet 120*a* may be formed on a side of the tub 10. The front of the tub 10 is open and closed by the door 3.

The duct outlet 120*a* and the duct inlet 110*a* are formed at the left side or the right side of the tub 10. The duct outlet 120*a* may be formed lower than the duct inlet 110*a*. The duct inlet 110*a* may be formed behind the duct outlet 120*a*, from the front of the tub 10. The duct inlet 110*a* is preferably arranged diagonally to the duct outlet 120*a* so that the air discharged from the duct outlet 120*a* can be discharged through the rear of the tub 10 after flowing up. The duct inlet 110*a* and the duct outlet 120*a* are spaced from each other so that the air in the tub 10 can be diffused as much as possible.

The channel of the air flowing in the tub 10 and the channel of the air discharge from the tub 10 can be indicated by the arrows A, B, C, D, E, F, and G. The air channel A may meet the air channel B through which external air flows inside. The air passing through the air channel A and the air passing through the air channel B flow through the air channel C. The air channel B may be closed by the external air adjuster 160. The air channel B is selectively opened/closed by the control unit 330. The heating unit 150 and the circulation fan 140 are disposed between the air channel C and the air channel D.

The air discharged from the circulation duct 100 can flow through the air channel E coming into the circulation duct 100 or the air channel F coming out to the outside. The air channel E is connected with the duct inlet 110*a*. The air channel F is connected with the discharge port 200*a*. The air flowing in the discharge duct 200 flows through the air channel G and is then discharged to the discharge port 200*b* of the door 3. Since the exhaust fan 210 is selectively driven, the air channels F and G may be closed.

A dishwasher 1 according to an exemplary embodiment of the present invention includes a door 3 opening/closing the tub 10 and an exhaust fan 210 disposed in the door 3 and sending the air in the tub 10 to a discharge duct 200, in which the door 3 has a discharge port 200*a* that communicates with the tub 10 so that the air in the tub 10 can flow to the discharge duct 200. The door 3 opens/closes the front of the cabinet 2. The door 3 closes the tub 10. The door 3 pivotably coupled to the front of the cabinet 2. The door 3 is equipped with the exhaust fan 210. The discharge duct 200 is disposed in the door 3.

The discharge port 200*a* communicates with the tub 10. The air in the tub 10 is sent to the discharge duct 200 through the discharge port 200*a* by the exhaust fan 210. The air flowing through the discharge duct 200 flows to the bottom of the door 3 and is discharged through the discharge port 200*b* of the door 3. The exhaust fan 210 is connected with the control unit 330. The control unit 330 controls the exhaust fan 210 such that the exhaust fan 210 can be started at a predetermined point of time. The sensing unit 310 can sense the temperature and/or moisture of the air in the air circulating in the tub 10 and/or the operation time of the drying cycle, etc.

The control unit 330 can determine the time of operating the exhaust fan 210 in accordance with the sensing value of the sensing unit 310. The control unit 330 can operate the exhaust fan 210 at the determined time. The time of operating the exhaust fan 210 may be determined in advance. The control unit 330 controls the rotational speed of the exhaust fan 210. The control unit 330 can control the exhaust fan 210 to start and/or stop.

According to an exemplary embodiment of the present invention, the duct outlet 120*a* and the discharge port 200*a* are vertically arranged so that the air discharged from the duct outlet 120*a* flows up to the discharge port 200*a*. The door 3 is disposed on the open front of the tub 10. The discharge port 200*a* is formed in the door 3.

The duct outlet 120*a* and the duct inlet 110*a* are formed at one side of the tub 10. Preferably, they are vertically formed so that the air discharged through the duct outlet 120*a* can flow up to the duct inlet 110*a* and the duct outlet 120*a*. Most preferably, the duct inlet 110*a* is formed above the duct outlet 120*a* and the discharge port 200*a* is formed higher than the duct inlet 110*a*.

The circulation duct 100 according to an exemplary embodiment of the present invention includes a circulation intake duct 110 that communicates with the duct inlet 110*a* and through which air flows and a circulation discharge duct 120 of which one side is open so that the air flows from the circulation intake duct 110 and other side communicates with the duct outlet 120*a*.

The air flowing into the duct inlet 110*a* flows through the circulation intake duct 110. The air flowing through the circulation intake duct 110 moves to the circulation discharge duct 120. The air flowing through the circulation discharge duct 120 is discharged to the duct outlet 120*a*.

The circulation intake duct 110 according to an exemplary embodiment of the present invention bends so that the air flowing inside flows up and then drops. One side of the circulation intake duct 110 communicates with the tub 10 and the other side extends under the tub 10. The circulation intake duct 110 extends downward after bending at the top. A portion of the circulation intake duct 110 may be disposed in contact with the cabinet.

The circulation discharge duct 120 according to an exemplary embodiment of the present invention bends so that the air from the circulation intake duct 110 flows up and drops, and is then discharged to the duct outlet 120*a*. One side of the circulation discharge duct 120 communicates with the tub 10 and the other side extends under the tub 10.

According to an exemplary embodiment of the present invention, at least one of the circulation duct 100 and the discharge duct 200 includes a condensation wall 130 elongated in the flow direction of air so that moisture in air condensates. Preferably, a plurality of condensation walls 130 may be formed. The condensed-water produced by coming in contact with the condensation wall 130 flows down.

The dishwasher according to an exemplary embodiment of the present invention includes a drain pipe (not shown) through which the wash water sprayed to the tub 10 flows to be discharged to the outside and the circulation duct 100 is connected with the drain pipe so that the condensed-water in the circulation duct 100 is collected and discharged to the outside. Preferably, the lower end of the circulation duct may be connected with the drain pipe.

One side of the circulation duct 100 is elongated under the tub 10. Sides of the circulation intake duct 110 and the circulation discharge duct 120 extend under the tub 10. The drain pipe is connected with at least any one of the circulation intake duct 110 and the circulation discharge duct 120.

The dishwasher 1 according to an exemplary embodiment of the present invention includes a heating unit 150 that heats the air flowing through the circulation duct 100.

The heating unit 150 is disposed under the tub 10. A machine room receiving the wash pump 45 that pressurizes wash water and a sump 60 where the wash water sprayed to the tub 10 collects is disposed under the tub 10. The heating unit 150 is disposed in the machine room. The heating unit 150 is disposed between the circulation intake duct 110 and the circulation discharge duct 120 and exchanges heat with flowing air. For example, one side of the heating unit 150 may communicate with the circulation intake duct 110 and the other side may communicate with the circulation discharge duct 120. The heating unit 150 is connected with the control unit 330. The control unit 330 controls the operation of the heating unit 150. The control unit 330 can determine the temperature and/or the operation time and/or the stop time of the heating unit 150.

The dishwasher 1 according to an exemplary embodiment of the present invention includes a circulation fan 140 that rotates so that the air in the tub 10 flows into the circulation duct 100. The circulation fan 140 sucks and/or discharges air from/to the circulation duct 100. For example, one side of the circulation fan 140 may communicate with the circulation intake duct 110 and the other side may communicate with the circulation discharge duct 120. The circulation fan 140 is disposed between a circulation intake duct 110 and a circulation discharge duct 120 and rotates to suck and/or discharge air. The control unit 330 is connected with the circulation fan 140. The control unit 330 controls the operation of the circulation fan 140. The control unit 330 can determine the rotational speed and/or the operation time and/or the stop time of the circulation fan 140.

The circulation fan 140 according to an exemplary embodiment of the present invention is disposed in the machine room formed under the tub and receiving electric parts for washing and drying dishes. The circulation intake duct 110 and the circulation discharge duct 120 extend toward the machine room.

The circulation duct 100 according to an exemplary embodiment of the present invention has an external air inlet 110*b* so that external air can flows inside and into the tub 10. The external air inlet 110*b* may be formed at one side of the circulation duct 100. External air may be sucked into the external air inlet 110*b* by the circulation fan 140. Preferably, the external air inlet 110*b* is formed at the circulation intake duct 110. More preferably, the external air inlet 110*b* is formed in the path along which the circulation duct 100 bends at the top and extends downward. The external air inlet 110*b* may communicate with the rear of the cabinet.

The circulation duct according to an exemplary embodiment of the present invention includes an external air adjuster 160 that adjusts the flow rate of air flowing into an external air intake hole. The external air adjuster 160 controls opening/closing of the external air inlet 110*b*. The external air adjuster 160 may be a valve controlling inflow of air. The control unit 330 is connected with the external air adjuster 160. The control unit 330 controls opening/closing of the external air adjuster 160. The control unit 330 can determine the point of opening time and/or the point of closing time of the external air adjuster 160.

According to an exemplary embodiment of the present invention, the dishwasher includes an exclusive dry button 333 for individually performing a drying process in accordance with selection of a user.

The exclusive dry button 333 may be formed in the input unit 300 on the front of the door 3. The input unit 300 may be disposed on the front of the cabinet 2. The exclusive dry button 333 allows a drying process to be individually performed, even without the wash cycle that sprays wash water with a detergent and/or a rinse cycle for rinsing out dishes after the wash cycle.

When the exclusive dry button 333 is pressed, the control unit 330 gives an instruction of exclusive drying. The control unit 330 can directly drive the circulation fan 140 and/or a heating unit 150 without the wash cycle and/or the rinse cycle. The control unit 330 can drive the exhaust fan 210 or stops other electric parts, depending on the predetermined time or the result of the sensing value.

A dishwasher 1 according to an exemplary embodiment of the present invention may include a tub 10, a circulation duct 100 connected to the outer side of the tub 10 so that air is discharged into the tub 10 and the discharge air is sucked back, a heating unit 150 heating the air flowing through the circulation duct 100, and a circulation fan 140 rotating to suck the air in the tub 10 and discharge the sucked air back to the tub 10 through the circulation duct 100.

A dishwasher 1 according to an exemplary embodiment of the present invention may include a tub 10, a heating unit 150 heating air, a circulation duct 100 that communicates with the tub 10 so that the air heated by the heating unit 150 is discharged into the tub 10 and the discharged air is sucked back to flow to the heating unit 150, and a circulation fan 140 rotating so that air flows to the circulation duct.

A dishwasher according to an exemplary embodiment of the present invention may include a tub 10, a circulation duct 100 communicating with at least two portions of the duct 10 so that the air in the tub 10 is sucked and the sucked air is discharged back to the tub 10, and a condensation wall 130 is disposed in the circulation duct 100 and elongated in the flow direction of air so that the moisture in the air discharged from the tub 10 condensates on the condensation wall 130.

A dishwasher 1 according to an exemplary embodiment of the present invention may include a tub 10, a circulation intake duct 110 of which one side communicates with the tub 10 so that the air in the tub 10 flows inside and the other side having an external air intake hole formed so that the air outside the tub 10 flows inside, a circulation fan 140 rotating to suck and discharge the air flowing through the circulation intake duct, a circulation discharge duct 120 communicating with the tub 10 so that the air discharged from the circulation fan 140 flows and is then discharged to the tub 10, and a discharge duct 200 communicating with the tub 10 so that the air in the tub 10 and the air outside the tub 10 which flows into the external air intake hole are mixed and discharged to the outside of the tub 10.

A dishwasher 1 according to an exemplary embodiment of the present invention includes a tub 10 having a dishwashing space, a duct inlet 110*a* through which air flows inside, and a duct outlet 120*a* through which air is discharged, a circulation fan 140 disposed under the tub 10 and makes circulation of air between the duct outlet 120*a* and the duct inlet 110*a*, a heating unit 150 disposed under the tub 10 and heating the air flowing by the circulation fan 140, and a circulation duct 100 communicating with the duct outlet 120*a* and the duct inlet 110*a*, extending under the tub 10, and communicating with the circulation fan 140 and the heating unit 150.

FIG. 6 is a flowchart illustrating a method of controlling a dishwasher according to an exemplary embodiment of the present invention, FIG. 7 is a flowchart schematically illustrating a method of controlling a circulation fan according to an exemplary embodiment of the present invention, and FIG. 8 is a flowchart illustrating a method of controlling a dishwasher according to another exemplary embodiment of the present invention.

Referring to FIGS. 6 to 8, a method of controlling a dishwasher 1 according to an exemplary embodiment of the present invention includes driving the circulation fan 140 disposed in the circulation duct 100 communicating with at least two portions of the tub to discharge air into the tub (S201), opening the external air inlet 110*b* of the circulation duct 100 so that the air outside the tub 10 flows into the circulation duct 100, making the air, which is discharged from the circulation duct 100, flow in the tub 10, and driving the exhaust fan 210 so that the air flowing in the tub 10 is discharged to the outside (S205).

A method of controlling a dishwasher according to an exemplary embodiment of the present invention includes driving the circulation fan 140 in the circulation duct 100 communicating with at least two portions of the tub 10 (S110), controlling a rotational speed to change the rotational speed of the circulation fan (S130), and driving the exhaust fan to discharge the air in the tub 10 to the outside (S150).

The control unit 330 operates the exhaust fan 140, when a drying cycle starts. The control unit 330 can circulate the air in the tub 10. The control unit 330 controls opening/closing of the external air adjuster 160. The control unit 330 can make external air flow into the circulation duct 100 by opening the external air adjuster 160. The control unit 330 can make external air flow into the tub 10. Wash water on dishes vaporize. The vaporizing wash water is mixed with the air flowing in the tub 10.

The control unit 330 discharges the air in the tub 10 to the outside by operating the exhaust fan 210. The exhaust fan 210 is connected with the control unit 330. The control unit 330 controls the exhaust fan 210 such that the exhaust fan 210 can be started at a predetermined point of time. The sensing unit 310 can sense the temperature and/or moisture of the air in the air circulating in the tub 10 and/or the operation time of the drying cycle, etc.

The control unit 330 can determine the time of operating the exhaust fan 210 in accordance with the sensing value of the sensing unit 310. The control unit 330 can operate the exhaust fan 210 at the determined time. The time of operating the exhaust fan 210 may be determined in advance. The control unit 330 controls the rotational speed of the exhaust fan 210. The control unit 330 can control the exhaust fan 210 to start and/or stop. The method includes driving the heating unit 150 that increases the temperature of the air discharged from the circulation duct 100 by exchanging heat with the air flowing through the circulation duct 100 (S201).

The heating unit 150 is connected with the control unit 330. The control unit 330 controls the operation of the heating unit 150. The control unit 330 can determine the temperature and/or the operation time and/or the stop time of the heating unit 150. The control unit 330 can increase the amount of saturated vapor by increasing the temperature of air.

Although FIGS. 6 to 8 show that the circulation fan 140, the exhaust fan 210, and the heating unit 150 are stopped, when drying is finished, the present invention is not necessarily limited thereto. For example, when the exhaust fan 210 is operated, the heating unit 150 may be stopped, or when the exhaust fan 210 is operated, the external air adjuster 160 may be opened and the circulation fan 140 is stopped. Further, it is possible to repeat operating the circulation fan 140 and the exhaust fan 210 several times.

The step of operating the exhaust fan 210 and/or the step of driving the circulation fan 140 and/or the step of driving the heating unit 150 may be repeated at appropriate intervals. Starting and stopping of the exhaust fan 210, the circulation fan 140, and the heating unit 150 may be set in different way in accordance with the ability of sucking/discharging of the circulation fan 140 and the ability of heat exchanging of the heating unit 150. Further, opening of the exhaust fan 210 and the external air adjuster 160 may be periodically performed. The driving of the circulation fan (S201) in FIG. 8 may increase drying efficiency by driving the circulation fan at the first rotational speed in FIG. 6 (S110) or driving the circulation fan at the second rotational speed (130).

The dishwasher 1 with the configuration described above according to an exemplary embodiment of the present invention and the method of controlling the dishwasher are described hereafter.

The control unit 330 operates the exhaust fan 140, when a drying cycle starts. Since the circulation fan 140 is disposed in the circulation duct 100, it sucks the air in the tub 10 and discharges air back to the tub 10.

The air flowing through the circulation duct 100 flows while exchanging heat with the heating unit 150. Accordingly, the air in the tub 10 continuously increases in temperature to a predetermined point of time. That is, the air in the tub 10 is not wasted until a predetermined point of time and continuously circulates, so the thermal efficiency is high. The control unit 330 drives the circulation fan 140 at the first rotational speed. The control unit 330 drives the circulation fan 140 at the second rotational speed, when a predetermined time passes.

The area where the vapor produced in the tub 10 and the air discharged from the circulation duct 100 are mixed is changed by the difference in rotational speed of the circulation fan 140. Accordingly, it is possible to dry from the area close to the circulation duct 100 to the area far from it in stages. Further, when dishes are randomly disposed, it is possible to intensively dry desired areas.

When a predetermined condition is satisfied, the control unit 330 drives the exhaust fan 210. The amount of vapor increases, when the heated air and the vapor are mixed, so as the exhaust fan 210 is driven, the amount of vapor in the tub 10 decreases. Further, the process described above may be performed, when an exclusive drying instruction is inputted.

Although exemplary embodiments of the present invention are illustrated and described above, the present invention is not limited to the specific exemplary embodiments and may be modified in various ways by those skilled in the art without departing from the scope of the present invention described in claims, and the modified examples should not be construed independently from the spirit of the scope of the present invention.

What is claimed is:

1. A method of controlling a dishwasher, comprising:
driving a circulation fan disposed in a circulation duct that communicates with at least two portions of a tub;
controlling a rotational speed to change the rotational speed of the circulation fan based on a position of dishes in the tub; and
driving an exhaust fan to discharge air in the tub to the outside.

2. The method of claim 1, wherein the controlling of a rotational speed includes:
driving the circulation fan at a first rotational speed; and
driving the circulation fan at a second rotational speed that is higher than the first rotational speed.

3. The method of claim 2, wherein the controlling of a rotational speed alternately performs the driving of the circulation fan at the first rotational speed and the driving of the circulation fan at the second rotational speed.

4. The method of claim 1, wherein the controlling of a rotational speed is performed when the humidity of air flowing through the circulation duct is a predetermined humidity or less.

5. The method of claim 1, further comprising:
driving a heating unit to heat air flowing through the circulation duct.

6. A dishwasher comprising:
a tub forming a dishwashing space;
a circulation duct having a first opening to discharge air into the tub and a second opening through which air discharged from the tub is introduced;
a circulation fan of which rotation speed is controllable; and
a controller that controls the rotation speed of the circulation fan to adjust a circulation range that the air discharged from the first hole reached while traveling to the second hole,
wherein the rotational speed of the circulation fan changes in accordance with the position of dishes in the tub.

7. The dishwasher of claim 6, wherein the tub has a duct inlet that is open so that the air in the tub is discharged and flows into the circulation duct and a duct outlet that is open so that the air discharged from the circulation duct flows inside the tub, and the duct inlet and the duct outlet are vertically arranged so that the air flowing in the tub vertically circulates.

8. The dishwasher of claim 6, wherein the circulation fan includes a variable motor that operates at least two-stage rotational speeds.

9. The dishwasher of claim 8, further comprising:
a control unit that controls the variable motor to circulate the air close to the duct inlet and the duct outlet by reducing the rotational speed of the circulation fan and to circulate the air further from the duct inlet and the duct outlet by increasing the rotational speed of the circulation fan.

10. The dishwasher of claim 6, further comprising:
a discharge duct to discharge air from the tub to outside of the tub; and
an exhaust fan arranged in the discharge duct,
wherein the controller drives the exhaust fan when the circulation fan stops.

11. The dishwasher of claim 9, further comprising:
a sensing unit that senses humidity of the air flowing through the circulation duct,
wherein the control unit controls the rotational speed of the circulation fan on the basis of information from the sensing unit.

12. The dishwasher of claim 9, further comprising:
a sensing unit that senses humidity of the air flowing through the circulation duct,
wherein the control unit controls the point of time to drive the exhaust fan on the basis of information from the sensing unit.

13. The dishwasher of claim 7, wherein the circulation duct includes:

a circulation intake duct that extends upward from the duct inlet and then bends downward; and a circulation discharge duct that extends upward and then bends downward, and communicates with the duct outlet.

14. The dishwasher of claim 13, further comprising:

a heating unit that is disposed between the circulation intake duct and the circulation discharge duct to heat air.

15. The dishwasher of claim 6, further comprising:

an exclusive dry button for selection of a user and a controller that drives the circulation fan on the basis of information from the exclusive dry button.

16. The dishwasher of claim 6, further comprising:

a condensation wall in the circulation duct that condensates moisture in the air flowing through the circulation duct.

17. The dishwasher of claim 6, further comprising:

an external air inlet that allows external air into the circulation duct; and an external air adjuster that controls inflow of the external air through the external air inlet.

18. A dishwasher comprising:

a tub that has a dishwashing space, a duct inlet through which air flows inside, and a duct outlet through which air is discharged;

a circulation fan that is disposed under the tub and circulates air between the duct outlet and the duct inlet, the rotation speed of which is controllable;

a heating unit that is disposed under the tub to heat the air flowing by the circulation fan;

a circulation duct that communicates with the duct inlet and the duct outlet, extends under the tub, and communicates with the circulation fan and the heating unit; and a controller that controls the rotation speed of the circulation fan to adjust a circulation range that the air discharged from the duct inlet reached while traveling to the duct outlet, wherein the rotational speed of the circulation fan changes in accordance with the position of dishes in the tub.

19. The dishwasher of claim 18, further comprising:

a discharge duct that sucks the air flowing in the tub through the circulation duct to an outside of the tub; and an exhaust fan that sucks air to the discharge duct, when the circulation fan stops.

* * * * *